US006435571B1

(12) United States Patent
Parietti

(10) Patent No.: US 6,435,571 B1
(45) Date of Patent: Aug. 20, 2002

(54) NECK TIE TYING TOOL

(76) Inventor: Michael I. Parietti, 1200 N. Veitch St. #1606, Arlington, VA (US) 22201

( * ) Notice: Subject to any disclaimer, the term of this patent is extended or adjusted under 35 U.S.C. 154(b) by 0 days.

(21) Appl. No.: 09/503,909

(22) Filed: Feb. 15, 2000

(51) Int. Cl.[7] ..... D03J 3/00

(52) U.S. Cl. ..... 289/17; 2/148; 2/152.1; 223/83

(58) Field of Search ..... 289/1.5, 2, 17, 289/18.1; 2/144, 145, 146, 148, 152.1; 223/81, 82, 83, 111

(56) References Cited

U.S. PATENT DOCUMENTS 2,148,582 A * 2/1939 Rodgers ..... 223/111
3,752,374 A * 8/1973 Pro ..... 223/111
5,390,370 A * 2/1995 Koy ..... 2/152.1
5,577,778 A * 11/1996 Parietti et al. ..... 289/17
6,120,068 A * 9/2000 DiPietro ..... 289/17

* cited by examiner

*Primary Examiner*—John J. Calvert
*Assistant Examiner*—Gary L. Welch

(57) ABSTRACT

A tool (10) is provided for creating an indentation, dimple or furrow in the portion of a necktie (20) that flows down and out of the knot (22) formed when the necktie is tied around a human neck. The tool includes a rigid fin (14). An elongate probe (16), projects from one end of the fin. The end of the elongate probe (18) is inserted into the bottom of the untightened knot in the necktie and pushed upward until it protrudes from the top of the knot. The necktie is then folded against the rigid fin and the tool is slid upward and downward alternately as the necktie knot is tightened down. As the necktie knot begins to tighten around the elongate probe, the tool is removed from the knot. At this point a dimple has formed in the portion of the necktie that flows down and out of the knot. The user will grasp this dimple between his forefinger and thumb and cinch down the knot to lock the dimple (32) in place.

1 Claim, 6 Drawing Sheets

NECK TIE TYING TOOL

TECHNICAL FIELD

This invention relates to personal appearance, the necktie and in particular to an attractively tied necktie.

BACKGROUND OF THE INVENTION

The proper wear of attire and clothing in an attractive and stylish manner is an important part of personal grooming. Much time and money is spent on preparing the appearance and style of one's clothing. An entire industry has developed full of products and services to fill this demand. The appearance of the necktie is an important part of the appearance of one's overall attire. The appearance of the knot used to tie the necktie is an important part of the appearance of the necktie in the overall appearance of one's attire. As the pace of life continues to accelerate there is increasing desire to minimize the time required to get dressed and attired in an attractive way and in particular to a tie necktie with an attractive and stylish knot. Therefore a need exists for an apparatus and method which assists in the tying of neckties and the creation of attractively tied necktie knots, in a minimum amount of time.

BACKGROUND DESCRIPTION OF PRIOR ART

The only relevant prior art was U.S. Pat. No. 5,577,778. The tool in that patent was comprised of three elements. A probe, a fin, and a sheet of flexible material. This claim only contains two of those elements, the fin and the probe.

SUMMARY OF THE INVENTION

In accordance with one aspect of the present invention, a tool is provided for creating an indentation or furrow in the portion of a necktie that flows down and out of the knot tied in the necktie. The tool has a blade like fin. An elongate probe is attached to one end of the fin.

In accordance with another aspect of the present invention, the elongate probe is preferably a cylinder coming to a rounded point at the first end.

In accordance with another aspect of the present invention, a method is provided for creating an indention or furrow in the portion of the necktie that flows down and out of the knot used to tie the necktie around the neck. The method includes the step of inserting the elongate probe of a tie tool into the knot tied in a necktie once the necktie has been tied around the neck but before it has been tightened down. The probe is inserted into the underside of the still loose knot. The method continues with the step of placing the fin of the ite tool against the surface of the tie below the knot and then folding the necktie symmetrically around the fin. This helps to form a dimple or indentation in the surface of the necktie. The method continues with the step of pulling downward on the tie and tool until the tip of the elongated probe is about to be withdrawn from the bottom of the knot. This helps to tighten the knot and create an indention in the surface of the necktie. The method continues with the step of halting the downward pull, easing ones grip on the tie and tie tool just enough to allow one to slide the tie tool upward towards the knot along the length of the tie while still keeping the necktie folded against the fin. At this point, the grasp of the first hand is retightened, and this process is repeated until the knot is almost completely tightened down an dan indention has been created in the surface of the necktie that flows down and out the knot. At this point, the tie tool is removed and the knot is pulled and cinched down tight.

BRIEF DESCRIPTION OF THE DRAWINGS

A more complete understanding of the invention can be had by referring to the following Detailed Description taken with the accompanying drawings, wherein.

DETAILED DESCRIPTION

Figure 1:
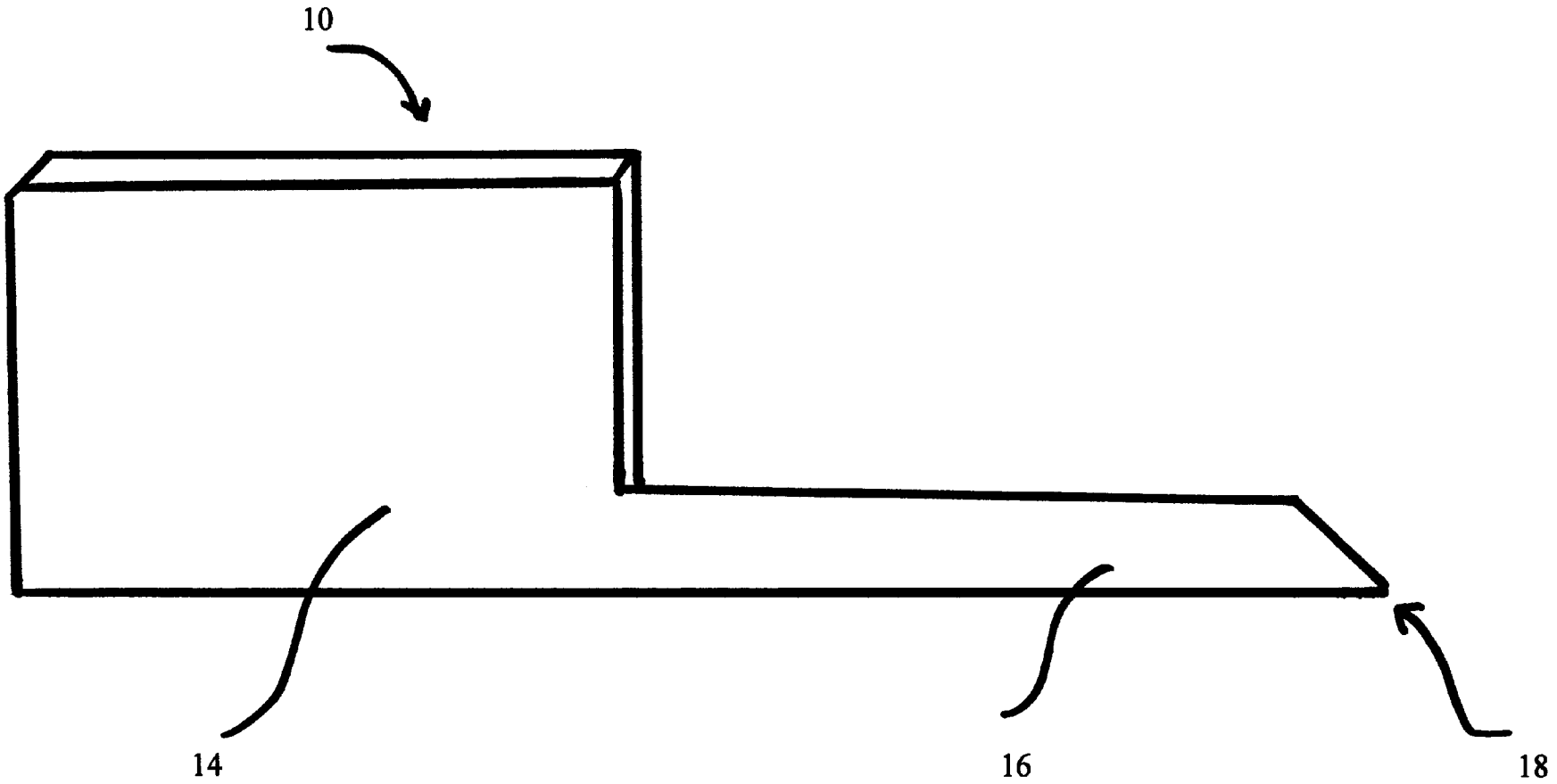
FIG. 1 is a side perspective view forming a first embodiment of the present invention.
Figure 2A:
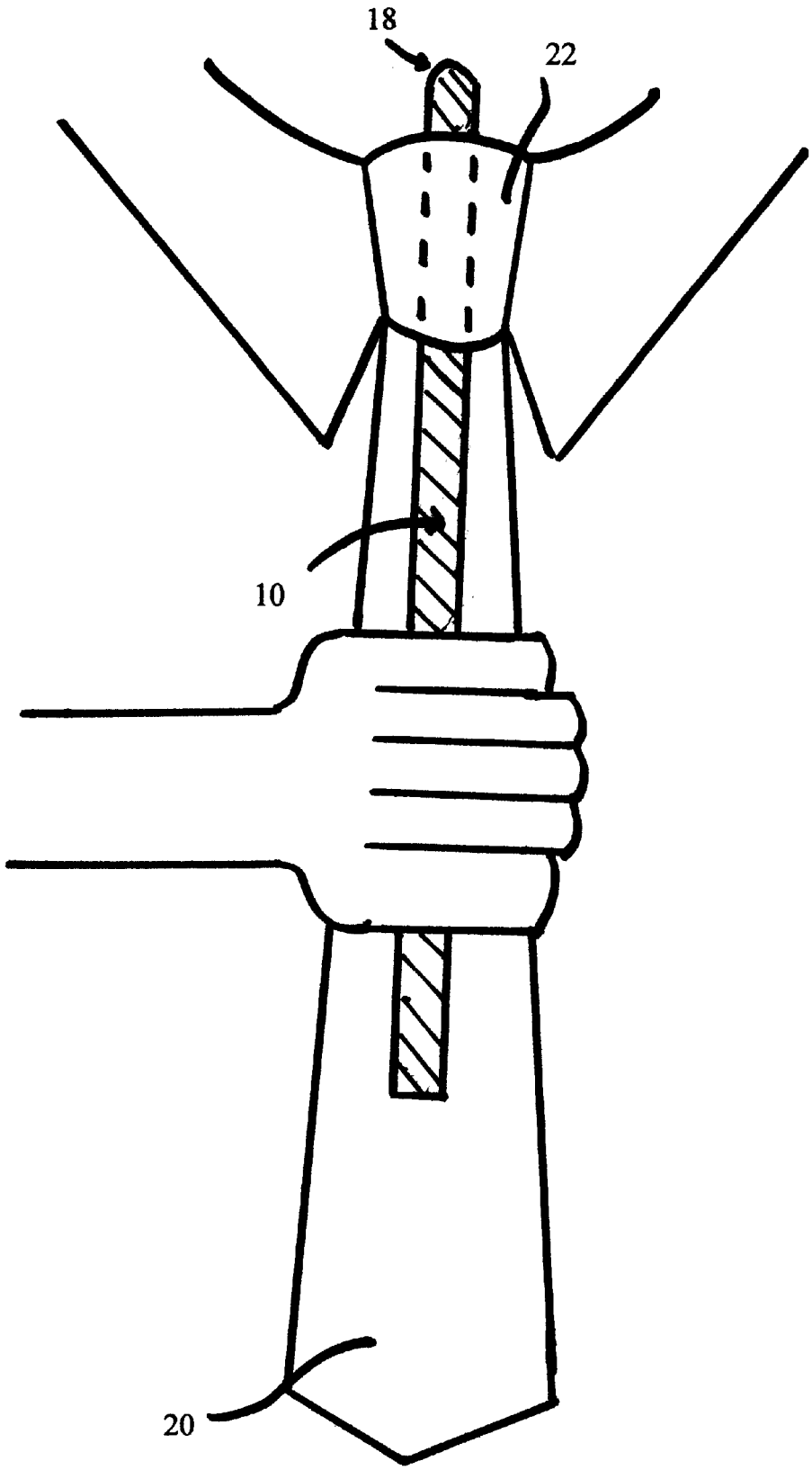
FIGS. 2A–2C illustrate the use of the tie tool to create an indention in a necktie.
Figure 2B:
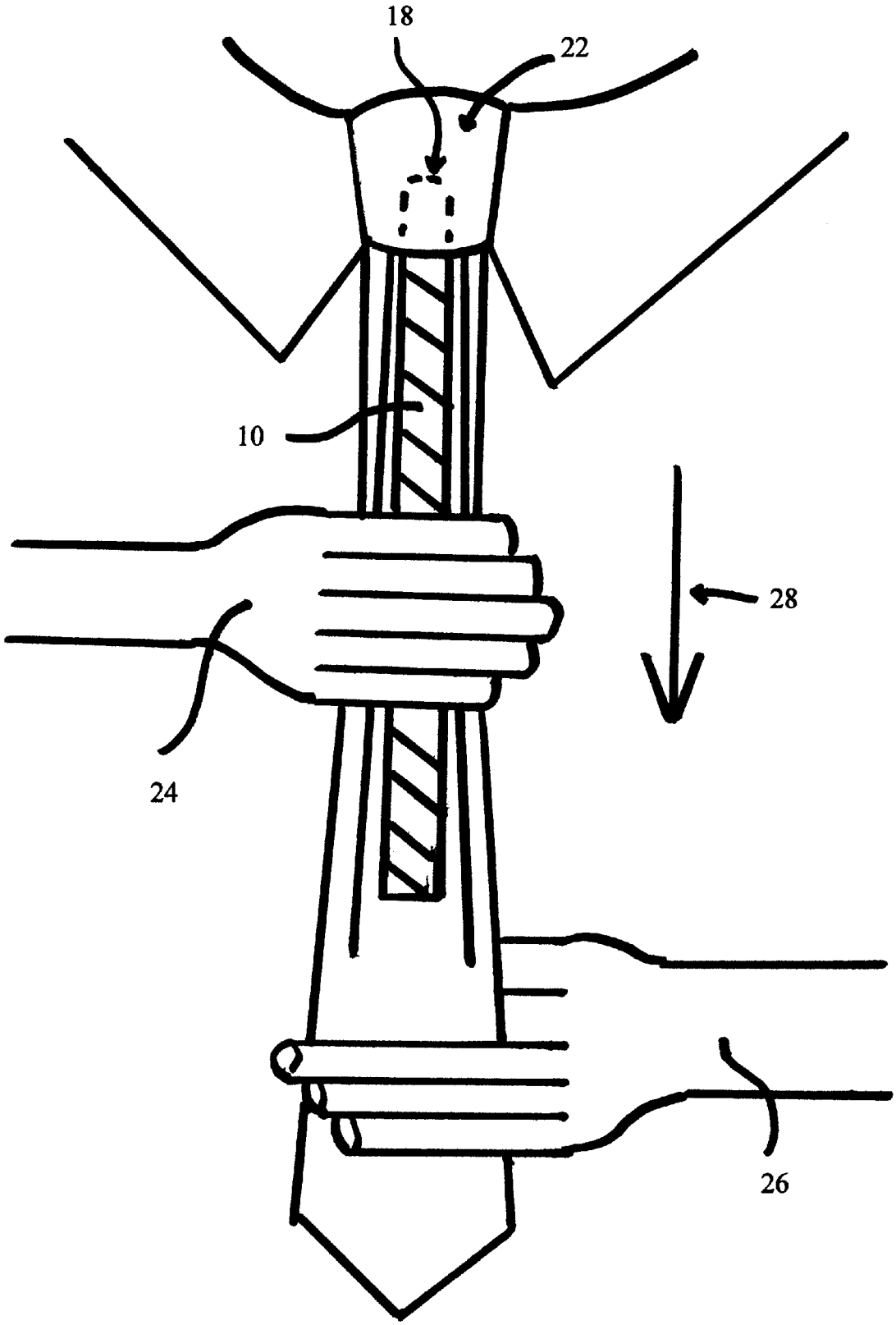
Figure 2C:
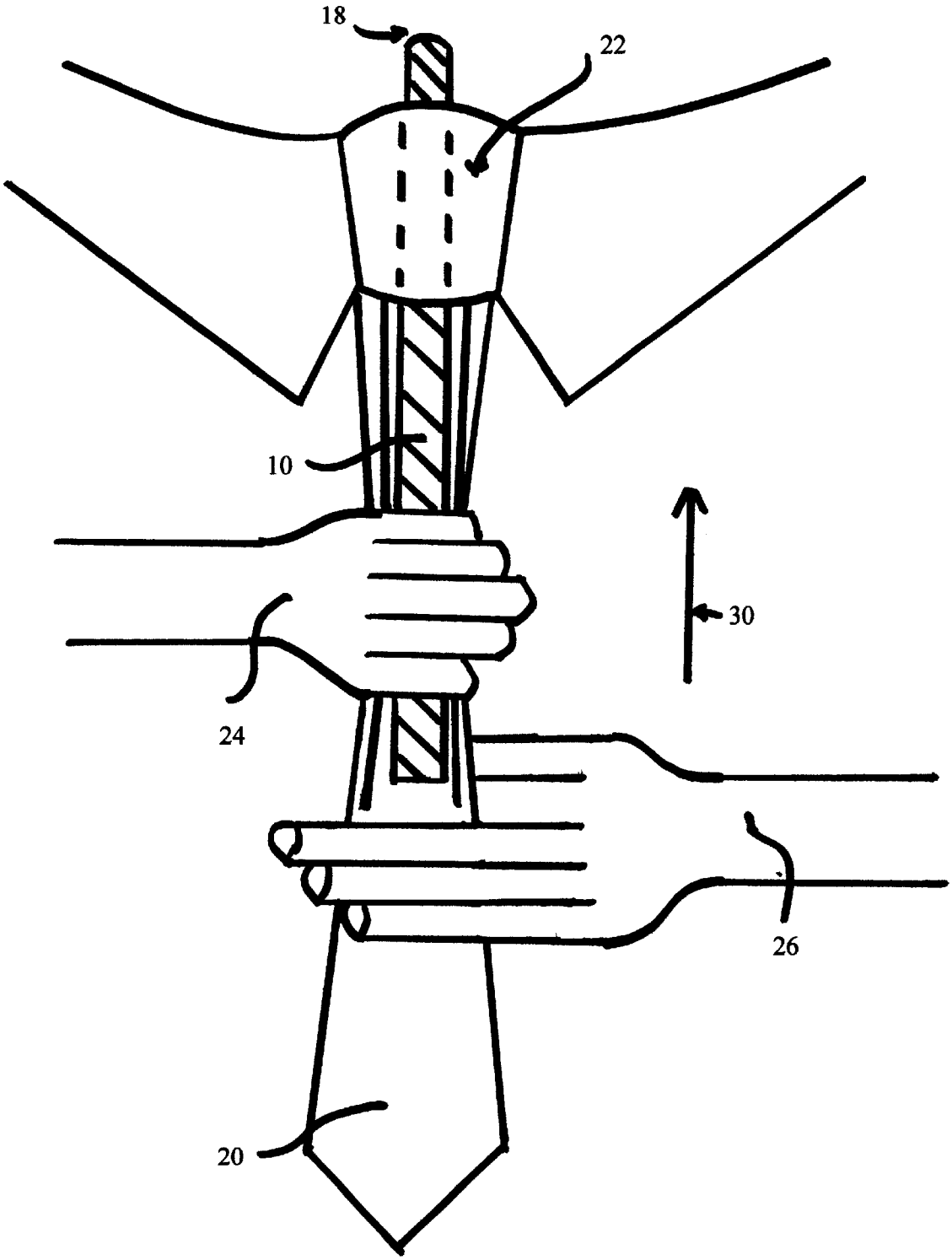
Figure 3:
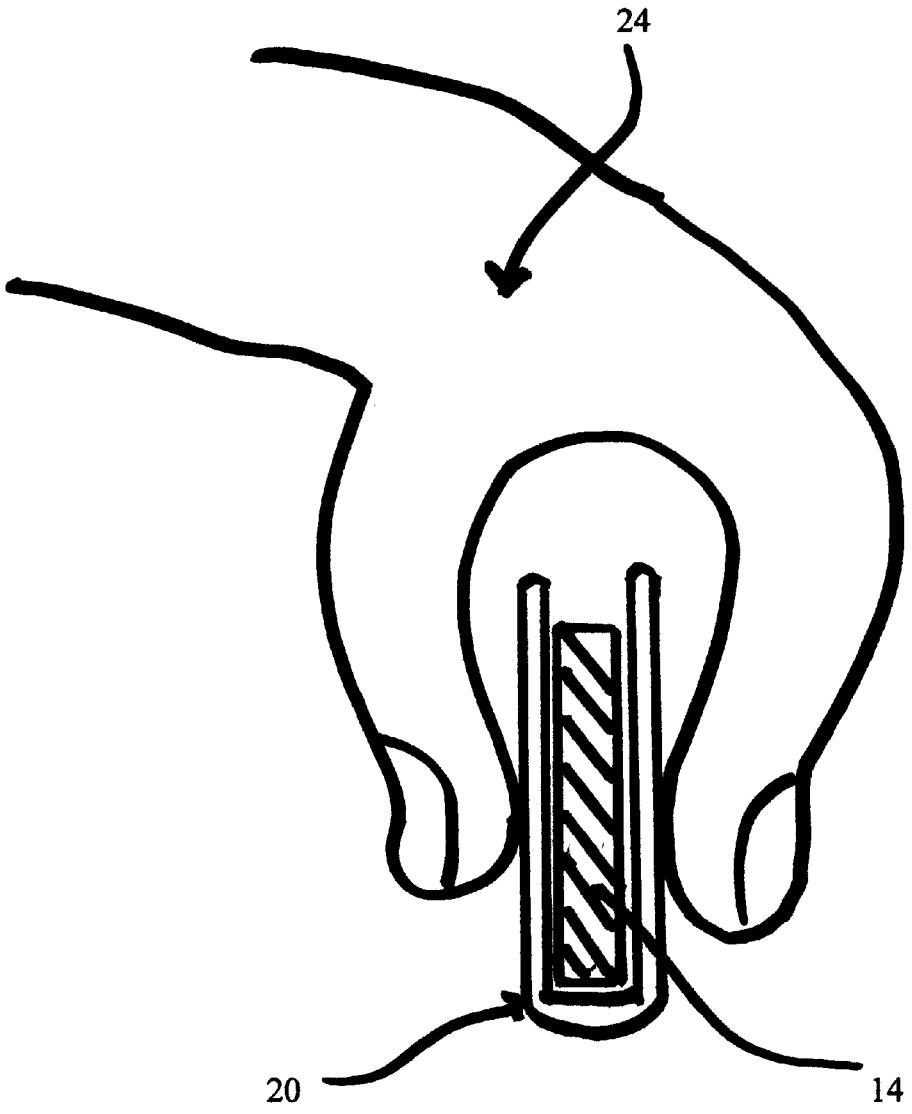
FIG. 3 is a cross sectional view of the first embodiment of the present invention as held by a human hand with a necktie folded over it as It would have been obvioius to one of ordinary skill in the art at the time the invention was made to be during usage.

Referring to the drawings now wherein like reference numerals designate like or corresponding parts throughout the several views, and in particular to FIG. 1 there is illustrated a tool, 10, forming a first embodiment of the present invention. The tool includes a fin or keel like structure, 14, attached to an elongate probe, 16, which narrows to a point at a first end, 18, and is attached by another end to one end of the fin. With reference now to FIGS. 2A thru 2C, the representation is made of a necktie, 20, of the fore-in-hand type tied around a human neck. As will be described hereinafter the tool can be used to create an indentation or dimple in the outward facing surface of the necktie where it flows down and out of the knot used to tie it around the neck. To be as clear as possible this indentation or dimple, 32, will be created in the surface of the tie that faces out to the public view or away from the wearer's neck. The indentation will be created in the portion of the necktie just below the knot, 22, where the tie hangs down toward the ground or the wearer's feet. See FIG. 4 This in turn will help create an attractive and stylish appearance of the necktie in general.

To create the indentation in the necktie, the point, 18, of the probe, 16, is inserted into the bottom of the knot, 22, in the necktie, the necktie being loosely tied around the neck but not yet tightened down completely, as shown in FIG. 2A. The elongate probe is pushed up into the knot until it protrudes out of the top. The point, 18, allows the probe to be inserted into the bottom of the knot and to glide into the knot with little friction and without pulling excessively on or catching on the necktie it self. The probe helps create a dimple in the outward facing surface of the portion of the necktie that flows down and out of the knot or, the outward facing surface of the portion of the necktie just below the knot.

Figure 4:
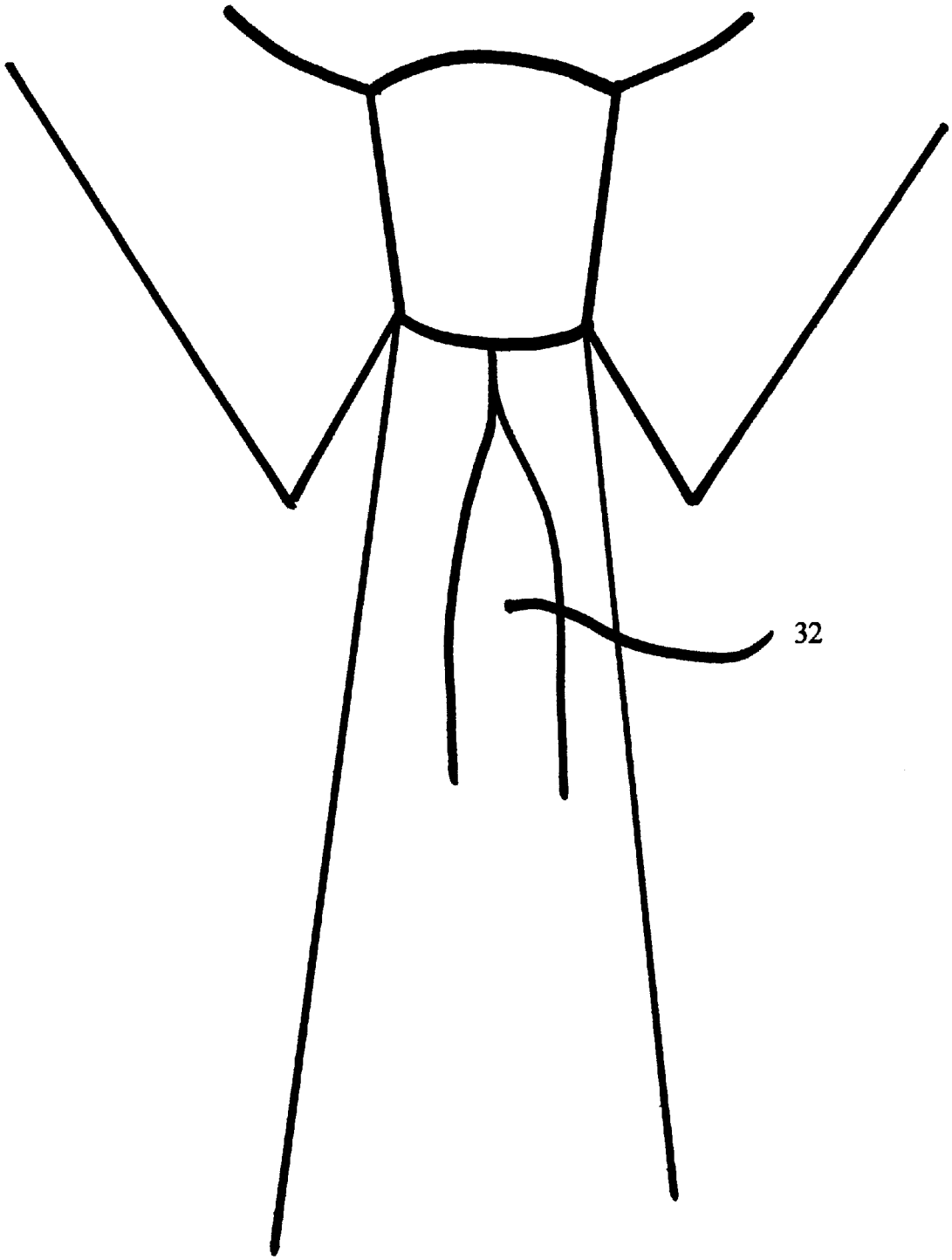
FIG. 4 shows the resulting dimple formed by using the present invention.

The fin, 14, is applied to the outward surface of the tie that will face out to the public view and away from the shirt or chest. The fin 14, is centered on the tie and pressed down into the tie bisecting it vertically along its length. This helps to create a dimple or indentation in the necktie as shown in FIG. 2A. The portion of the necktie on either side of the fin, 14, is then folded symmetrically onto the fin, 14, and thus helps to form a dimple or indentation in the necktie. At this point the tool, 10, is grasped with a first hand, 24. The second hand, 26, is used to grasp the tail or the narrow end of the necktie with the thumb and forefinger. Both the thumb and forefinger of the secondhand, 26, are behind or underneath the wide end of the necktie. The middle finger of the secondhand, 26, however, rests on the outward facing surface of the wide end of the necktie, with the wide end of the necktie running in between the forefinger and middle finger of the second hand, 26. Initially, the wide end of the necktie is not gripped by the forefinger and middle finger of the second hand 26, but only runs between these two fingers. While holding and grasping the tie and tie tool in this fashion the user will pull down on the necktie in the direction of arrow 28 in FIG. 2B. The tool is used to pull the necktie downward until the end, 18, of the probe, 16, is about to slip out of the knot in the necktie. At this point the downward pull is halted and the forefinger and middle finger of the second hand, 26, are squeezed or compressed together so as to grip the wide end of the necktie and hold it taut. This is shown in FIG. 2C. At this point one will ease his grip with a first hand, 24, on the tie and tie tool just enough to allow him to slide the tool upwards along the necktie, in the direction of arrow 30 in FIG. 2C. As the tool slides upward over the outward facing surface of the necktie it continues to keep an indentation in the tie. The tie tool is now slid upwards to its original position relative to the knot when the down stroke was, commenced. The end of the probe 18, will again be protruding through the top of the knot. Once slid upward, the first hand, 24, will again grip the necktie and tie tool tightly with the tie still folded symmetrically against the fin. Once again the tie tool is pulled downward in the direction of arrow 28. These steps are repeated until the knot in the necktie is tightened almost all the way down and an indentation or dimple is created in the outward facing surface of the portion of the necktie that flows down and out of the knot. At this point the tie tool is removed by releasing one's the grip on the necktie and tool and pulling downward so as to remove the tip, 18, of the probe from the knot. The final step in the process is to grasp the tie with one's fingers on either side of the newly created indentation or dimple and cinch the knot down tight this will create a tightened knot with an indentation or dimple, 32, in the portion of the necktie that flows down and out of the knot as shown in FIG. 4.

CONCLUSION, RAMIFICATIONS AND SCOPE OF INVENTION

Thus the reader will see that the tie tying tool and method of the invention provides a simple, quick, and easy way to create an attractive and stylish indentation or Dimple in the portion of the necktie that flows down and out of the knot when a necktie is tied around the neck. Depending on preference the tie tool, 10, can be made as an integral unit of one material, such as plastic, or in two or more parts welded, glued or otherwise secured together, which permits the probe or fin to be to be made in different materials. For example, the fin can be made of resilient plastic or rubber and the probe might be made metal or semi rigid plastic. Or, both the fin and probe might be made of plastic and being an integral unit of one material.

While my above description contains many specificities, these should knot be construed as limitations on the scope of the invention but rather as an exemplification of one preferred embodiment thereof. Many other variations are possible. For example, another embodiment would have a small finger or spur projecting from the opposite end of the fin from where the probe projects, and at a 90 degree angle to the probe so as to point outward and away from the use's chest, so as to enable the user to hook this spur with his pinky finger so as to assist in the upward motion of the tool when it is being slid back to its upward position with the point of the probe protruding from the top of the knot.

Another embodiment would have a flexible, malleable elongate probe that could be bent to different angles so as to create an indentation that was a little to the left or right or deeper than usual. The elongate probe would have a spring core or would be made out of a very malleable metal or alloy.

What is claimed is:

1. A tool for creating an indentation, dimple, furrow or crease in the portion of the necktie that flows down and out of a knot in the necktie when the necktie is tied around a wearers neck, said tool consisting of a bladelike fin, said tool further consisting of a semi rigid cylindrical probe which narrows to a point at a first end and is attached to said fin like blade by a second end said probe forming a longitudinal extension of said fin like blade.

* * * * *